US006478576B1

(12) United States Patent
Bradt et al.

(10) Patent No.: US 6,478,576 B1
(45) **Date of Patent: *Nov. 12, 2002**

(54) METHOD AND APPARATUS FOR CONTROLLING GASOLINE VAPOR EMISSIONS

(76) Inventors: Robert Bradt, 35261 Camino Capistrano, Capistrano Beach, CA (US) 92624; Thomas J. Smith, 13111 Equestrian La., Whittier, CA (US) 90601; Gilbert Castro, 7233 Sorensen, Whittier, CA (US) 90606

( * ) Notice: Subject to any disclaimer, the term of this patent is extended or adjusted under 35 U.S.C. 154(b) by 0 days.

This patent is subject to a terminal disclaimer.

(21) Appl. No.: 09/791,080

(22) Filed: Feb. 22, 2001

Related U.S. Application Data

(63) Continuation of application No. 09/258,041, filed on Feb. 25, 1999, now Pat. No. 6,193,500.
(60) Provisional application No. 60/076,157, filed on Feb. 26, 1998.

(51) Int. Cl.[7] ..... F23J 15/00; F23G 7/08
(52) U.S. Cl. ..... 431/202; 431/5; 141/59; 141/95; 220/749
(58) Field of Search ..... 431/202, 5, 351, 431/350, 353, 354, 11, 161, 164, 165; 141/59, 95; 220/750, 749; 422/168, 182

(56) References Cited

U.S. PATENT DOCUMENTS

| | | | | |
|---|---|---|---|---|
| 3,162,236 A | | 12/1964 | Williams | 431/202 |
| 3,807,940 A | | 4/1974 | Juricek | 431/202 |
| 3,985,494 A | * | 10/1976 | Childree | 431/202 |
| 3,999,936 A | * | 12/1976 | Hasselmann | 431/202 |
| 4,009,985 A | | 3/1977 | Hirt | 431/5 |
| 4,058,147 A | * | 11/1977 | Stary et al. | 141/59 |
| 4,118,170 A | | 10/1978 | Hirt | 431/5 |
| 4,140,471 A | | 2/1979 | Stroitz et al. | 431/202 |
| 4,292,020 A | | 9/1981 | Hirt | 431/5 |
| 4,680,004 A | | 7/1987 | Hirt | 431/5 |
| 4,960,166 A | | 10/1990 | Hirt | 431/5 |
| 5,484,000 A | * | 1/1996 | Hasselmann | 141/59 |
| 5,765,603 A | * | 6/1998 | Healy | 141/59 |
| 5,857,500 A | * | 1/1999 | Payne et al. | 141/59 |
| 6,193,500 B1 | * | 2/2001 | Bradt et al. | 431/5 |

* cited by examiner

*Primary Examiner*—Herry Bennett
*Assistant Examiner*—Josiah C. Cocks
(74) *Attorney, Agent, or Firm*—Stout, Uxa Buyan & Mullins, LLP; Donald E. Stout

(57) ABSTRACT

The present invention combines the gasoline vapor recovery efficiency advantages of a flirt "Partial Seal System", as disclosed, for example, in U.S. Pat. No. 4,680,004 to flirt, with the customer convenience advantages of gasoline vapor recovery systems employing "bootless" nozzles. The use of bootless nozzles in combination with strict environmental vapor emissions compliance is made possible because of specific system advantages, which include the use of a burner designed to operate at two different flow rates, a coaxial processor stack which permits second and third stage combustion of excess gasoline vapor generated by the system before it is released to atmosphere, and a remote sensor which continually monitors system vacuum pressure to ensure that a sufficient vacuum is maintained at all times. A major advantage of the present system is that the processor unit is adaptable for installation into existing gasoline vapor recovery systems and into other systems, including other manufacturer's systems.

38 Claims, 6 Drawing Sheets

| MODE | VACUUM SWITCHES | | | FLOW VALVES | | |
|---|---|---|---|---|---|---|
| | LESSER | HIGH FLOW | GREATER | PILOT | HIGH FLOW | MAIN |
| IDLE | CONTROLS VACUUM LEVEL | ON | OFF | OPEN | OPEN | OPEN |
| PRODUCT DISPENSING | OFF | ON/ OFF | CONTROLS VACUUM LEVEL | OPEN | OPEN/ CLOSED | OPEN |
| PRODUCT DISPENSING W/BULK DROP | OFF | ON/ OFF | CONTROLS VACUUM LEVEL | OPEN | OPEN/ CLOSED | OPEN |

Fig. 6

METHOD AND APPARATUS FOR CONTROLLING GASOLINE VAPOR EMISSIONS

This application is a continuation under 35 U.S.C. 120 of U.S. application Ser. No. 09/258,041, filed on Feb. 25, 1999, now U.S. Pat. No. 6,193,500, which in turn claims the benefit under 35 U.S.C. 119(e) of the filing date of Provisional Application Ser. No. 60/076,157, filed on Feb. 26, 1998.

BACKGROUND OF THE INVENTION

This invention relates to a system for controlling gasoline vapor emissions at a service station or stations where liquid gasoline is transferred from one container or tank to another, and more particularly to a bootless nozzle system for preventing the escape of vapors from the fuel tank of a vehicle during refueling, while at the same time preventing ingestion of fresh air into the fuel storage tank of a service station.

When a vehicle has consumed its supply of gasoline, its gasoline tank is full of gasoline vapors plus a lesser amount of liquid gasoline. During the process of dispensing a fresh supply of liquid gasoline into the tank, the vapor in the tank is displaced into the atmosphere. At the same time, fresh air is drawn down into the service station gasoline storage tank through provided vent pipes.

Gasoline vapors escaping into the atmosphere are a major source of smog and ozone. Fresh air, drawn into the storage tank, stimulates evaporation of the stored gasoline, which converts valuable gasoline into more polluting vapor.

The purpose of state of the art gasoline station vapor control systems is to solve both problems simultaneously; i.e. to prevent the escape of vapors from the vehicle tank and to prevent the ingestion of fresh air into the storage tank.

Because the volume of vapors escaping and the volume of fresh air ingested are approximately equal, the purpose of the system mechanism is to capture the vapors emitted from the vehicle tank and lead them through a conduit to the storage tank. As gasoline is dispensed from the storage tank, the storage tank ingests the vapor displaced from the vehicle tank instead of fresh air.

Pollution control agencies have increasingly mandated strict control standards for release of gasoline vapors into the atmosphere. For example, the California Air Resources Board (CARB) has mandated the following standards for vapor control systems:

1) Highest vapor efficiency in all weather conditions;
2) Zero fugitive emissions (emissions of vapor through unmonitored openings or gaps in a gasoline delivery system);
3) Automatic continuous self-diagnosis;
4) System tolerant of leaks in service station hardware;
5) System simple, tough, reliable, and economical; and
6) System must use best available control technology.

One gasoline vapor recovery system well known in the art is the so-called "Balance System". Such a system consists of a tight sealing vapor recovery nozzle 1*a* (FIG. 2), a vapor return hose, and vapor return piping. To prevent fugitive emissions, all vent pipes are equipped with a p/v valve (pressure/vacuum valve), which will not permit venting until the tank pressure exceeds approximately +3 inches w.c.g. (water column gauge).

The "Balance System" is simple and inexpensive, but has several disadvantages. Foremost among these are its failure to meet tough control standards such as those outlined above. For example, its vapor collection efficiency is often much less than 95% (typically its efficiency runs between 60 and 95%, depending upon ambient conditions and system maintenance), which is a government mandate in many localities. This loss of efficiency is caused by the fact that gasoline vapor is very sensitive to changes in temperature; i.e. when the temperature of the vehicle tank is colder than the storage tank, vapor transferred to the storage tank will expand. This expansion causes vapor to escape through any leak or opening it can find, usually due to poor system maintenance, thus destroying the vapor collection efficiency.

The "Balance System" requires a tight vapor seal at the nozzle/vehicle interface. Typically, this seal is created by employment of a vapor collecting bellows boot 2*a* (FIG. 2), which is adapted to fit tightly about the vehicle tank filler neck (not shown). This type of nozzle, however, is heavy, complicated, expensive, and difficult to use. Additionally, because of the tight seal, several internal safety devices are required so as not to overpressure the vehicle tank, and to prevent recirculation of gasoline back through the nozzle and hence back to the storage tank. Also, to contain vapor, all service station components must continuously remain leaktight.

A better solution is a loose fitting nozzle bellows boot 2*b* in a partial seal nozzle 1*b* (FIG. 3) which helps collect the vapor but does not seal tightly. In such a system, in order to prevent escape of vapors around the loose fit bellows boot, the prior art teaches that it is necessary to impose a vacuum on the vapor side of the nozzle. This is done in some prior art systems, sometimes referred to as Healy systems, by placing a vapor pump in the gasoline vapor return line between the underground gasoline storage tank and the dispensing nozzle 1*b*. A significant disadvantage to this approach is that the gasoline vapor is pressurized on the downstream side of the vapor pump, increasing its propensity to escape through any available leak, and making compliance with environmental regulations virtually impossible.

In other prior art systems, sometimes referred to as Hasselman systems, a vapor pump is placed in a line disposed between the gasoline vapor return line and a vapor vent line which exits the underground storage tank. In this prior art approach, a vapor burner is disposed at the discharge end of the vapor vent line. The burner actuates upon the sensing of a positive pressure in the gasoline storage tank. The disadvantage of this type of prior art system is that the magnitude of the positive pressure necessary to actuate the burner is too high to prevent leakage (fugitive emissions) of the pressurized vapor, but too low to properly feed a nozzle mixing type burner.

A significant problem with all of the foregoing systems is the operator's inability to actually measure the vapor recovery efficiency of the system. For example, still another prior art system is one presently in use in Mexico, which employs a monitoring system known as the ENVIROSENTRY ™. This system is an electronic system which monitors the gasoline storage tank for negative or positive pressure levels. The operating theory is that if any portion of the system, such as the vent lines, vapor pumps, or nozzles, fails, typically creating a blockage in the system, a vacuum will be created in the system. The vacuum is generated because gasoline is pumped at a greater rate than vapor is collected, due to the blockage. The system is set so that when the vacuum pressure reaches −6 to −8 water column, a switch will open, cutting a signal to the control panel. The loss of signal indicates to the control panel that there is a failure and an alarm will be activated. If the condition persists for more than sixty (60) minutes, the control panel will cut current to the pumps and the service station will be shut down.

The problem with this system is that the extreme vacuum pressure of −6 to −8 water column will never be reached by the typical poorly maintained service station. At about −0.5 water column, p/v valves in the vent risers, Stage I fittings, and other components will begin to leak, permitting air into the system to reduce the negative pressure without solving the malfunction.

The ENVIROSENTRY system also theoretically operates to detect a leak of gasoline vapor in the system. The operating theory is that during normal operation some type of pressure, positive or negative, will be generated. This will vary due to climatic conditions. If the pressure is zero for a long period of time, that indicates a problem. Therefore, when the system monitor detects a zero system pressure for a specified period of time, an alarm sequence will be triggered. After a predetermined period of time of continued zero pressure, the system will cut power to the pumps and the service station will be inoperative.

Again, the problem with this approach is that, due to leaks in the system, the pressure will never remain at zero for a long period of time.

A third system condition which ENVIROSENTRY is designed to monitor is a system overpressure of greater than 2.5 inches water column. If such a condition is detected, an alarm will sound, followed by system shutdown after continued overpressure conditions for a specified period of time. Again, the problem is that leaks will activate to release vapor to the environment, lowering the system pressure before +2.5 inches water column is attained, so the system will not operate as designed. As is the case with most existing systems, it is designed to placate government regulators rather than to effectively solve real problems.

Still another prior art approach is disclosed in U.S. Pat. No. 4,680,004 to Hirt. In this patent, which is also a thermal oxidation system employing a vapor burner, it is disclosed that placement of the vapor pump at the discharge end of the vent line, just upstream of the vapor burner, is a superior approach. This arrangement, known as the "Hirt partial seal system", permits the pump to create a vacuum in all vapor spaces (the nozzle, the hose, the vapor return piping, the storage tank, and the vent line), to thereby minimize vapor escape through leaks, and producing sufficient pressure on the burner which makes a clean, sharp flame. This is a superior design to the foregoing prior art systems, but requires a moderately well sealed system including a vapor collection boot at the nozzle/vehicle interface.

The booted nozzle, as shown in FIGS. 2 and 3, has been a problem for the self-serve customer, resulting in public rejection of the entire gasoline vapor control program. Furthermore, the booted nozzles are often misused by customers, by improperly "topping off" their vehicle tanks or improperly inserting the nozzle into the vehicle fill pipe. Both of these misuses result in the escape of vapor which causes the system to fail to comply with gasoline vapor recovery regulations. This public reaction has given rise to a requirement for a bootless nozzle, as shown in FIG. 4. But the bootless nozzle has no seal at the nozzle/vehicle interface. It is obvious, therefore, that a bootless nozzle which forms no seal would be completely incompatible with the partial seal system approach taught by the Hirt U.S. Pat. No. 4,680,004.

It would be desirable, therefore, to develop a gasoline vapor recovery system which combines the vapor processing advantages of the system disclosed by the Hirt U.S. Pat. No. 4,680,004 with the customer convenience advantages of a bootless nozzle.

SUMMARY OF THE INVENTION

The present invention combines the gasoline vapor recovery efficiency advantages of a Hirt "Partial Seal System", as disclosed, for example, in U.S. Pat. No. 4,680,004 to Hirt, with the customer convenience advantages of gasoline vapor recovery systems employing "bootless" nozzles. The use of bootless nozzles in combination with strict environmental vapor emissions compliance is made possible because of specific system advantages, which include the use of a burner designed to operate at two different flow rates, a coaxial processor stack which permits second and third stage combustion of excess gasoline vapor generated by the system before it is released to atmosphere, and a remote sensor which continually monitors system vacuum pressure to ensure that a sufficient vacuum for vapor retention and collection is maintained at all times. A major advantage of the present system is that the processor unit is adaptable for installation into existing gasoline vapor recovery systems.

More particularly, the present invention provides a gasoline vapor emission control system which comprises a gasoline storage tank and a dispenser with a nozzle and a hose for dispensing gasoline into a vehicle. A first conduit is disposed between the gasoline storage tank and the nozzle for supplying gasoline from the storage tank to the nozzle, and a second conduit is disposed between the nozzle and the gasoline storage tank for returning gasoline vapor from the nozzle to the gasoline storage tank. A third conduit is disposed between the gasoline storage tank and a processor unit for removing excess gasoline vapor from the gasoline storage tank. The processor unit is provided for processing excess gasoline vapor accumulating in the gasoline storage tank. The processor unit comprises a system for abating excess gasoline vapor and a pump for maintaining a vacuum pressure on the system. Advantageously, a remote self-zest monitor is provided for detecting and recording, in real time, the presence of vacuum pressure in the system.

In another aspect of the invention, there is provided a gasoline vapor emission control system which comprises a gasoline storage tank and a dispenser for dispensing gasoline into a vehicle. A first conduit is disposed between the gasoline storage tank and the dispenser for supplying gasoline from the storage tank to the dispenser, and a second conduit is disposed between the dispenser and the gasoline storage tank for returning gasoline vapor from the dispenser to the gasoline storage tank. A third conduit is disposed between the gasoline storage tank and atmosphere for removing excess gasoline vapor from the gasoline storage tank. A processor unit is provided for processing excess gasoline vapor accumulating in the gasoline storage tank. The processor unit comprises a burner for thermally oxidizing excess gasoline vapor and a pump for maintaining a vacuum pressure on the system, and further advantageously comprises a coaxial processor stack assembly for releasing combustion products emitted from the burner, wherein the stack assembly comprises an inner stack and a coaxial outer stack disposed about the inner stack.

In yet another aspect of the invention, there is provided a gasoline vapor emission control system which comprises a gasoline storage tank and a dispenser for dispensing gasoline into a vehicle. The dispenser advantageously includes a bootless nozzle. A first conduit is disposed between the gasoline storage tank and the bootless nozzle for supplying gasoline from the storage tank to the bootless nozzle, and a second conduit is disposed between the bootless nozzle and the gasoline storage tank for returning gasoline vapor from the bootless nozzle to the gasoline storage tank. A third conduit is disposed between the gasoline storage tank and a processor unit for removing excess gasoline vapor from the gasoline storage tank. The processor unit is provided for processing excess gasoline vapor accumulating in the gasoline storage tank. The processor unit comprises a burner for thermally oxidizing excess gasoline vapor and a pump for maintaining the presence of vacuum pressure in the system.

In still another aspect of the invention, there is provided a gasoline vapor emission control system which comprises a gasoline storage tank and a dispenser for dispensing gasoline into a vehicle. A first conduit is disposed between the gasoline storage tank and the dispenser for supplying gasoline from the storage tank to the dispenser, and a second conduit is disposed between the dispenser and the gasoline storage tank for returning gasoline vapor from the dispenser to the gasoline storage tank. A third conduit is disposed between the gasoline storage tank and atmosphere for venting excess gasoline vapor from the gasoline storage tank. A processor unit is provided for processing excess gasoline vapor accumulating in the gasoline storage tank. The processor unit comprises a burner for thermally oxidizing excess gasoline vapor and a pump for maintaining a vacuum pressure on the system. Advantageously, the system includes a multipath pipetrain for directing the excess gasoline vapor to the processor unit, which permits the burner to operate at two different volumetric flow rates, thereby ensuring that an adequate vacuum pressure can be maintained on the entire system during all operating regimes.

In yet still another aspect of the invention, a processor subsystem for use in a gasoline vapor recovery system is provided, the gasoline vapor emission control system comprising a gasoline storage tank, a dispenser for dispensing gasoline into a vehicle, and a conduit disposed between the gasoline storage tank and atmosphere for venting excess gasoline vapor from the gasoline storage tank. The inventive processor subsystem comprises a processor unit for processing excess gasoline vapor accumulating in the gasoline storage tank. The processor unit includes a burner for thermally oxidizing excess gasoline vapor and a pump for maintaining a vacuum pressure on the system. The subsystem advantageously further comprises a remote self-test monitor for detecting and recording, in real time, the pressure of the system.

In another aspect of the invention, a processor subsystem is provided for use in a gasoline vapor emission control system which comprises a gasoline storage tank, a dispenser for dispensing gasoline into a vehicle, and a conduit disposed between the gasoline storage tank and atmosphere for venting excess gasoline vapor from the gasoline storage tank. The inventive processor subsystem comprises a processor unit for processing excess gasoline vapor accumulating in the gasoline storage tank, which includes a burner for thermally oxidizing excess gasoline vapor and a pump for maintaining a vacuum pressure on the system, and a coaxial processor stack assembly for releasing combustion products emitted from the burner. The stack assembly comprises an inner stack and a coaxial outer stack disposed about the inner stack.

In still another aspect of the invention, a processor subsystem is provided for use in a gasoline vapor emission control system which comprises a gasoline storage tank, a dispenser for dispensing gasoline into a vehicle, and a conduit disposed between the gasoline storage tank and atmosphere for venting excess gasoline vapor from the gasoline storage tank. The inventive processor subsystem comprises a processor unit for processing excess gasoline vapor accumulating in the gasoline storage tank, which includes a burner for thermally oxidizing excess gasoline vapor and a pump for maintaining a vacuum pressure on the system. The processor subsystem further comprises a multipath pipetrain for directing the excess gasoline vapor to the processor unit.

The invention, together with additional features and advantages thereof, may best be understood by reference to the following description taken in conjunction with the accompanying illustrative drawing.

BRIEF DESCRIPTION OF THE DRAWINGS

FIG. 6 is a table illustrating the control parameters for the processor of FIG. 5 in typical operation in three different modes, particularly with respect to actuation of the three flow valves in the vapor recovery system;

DESCRIPTION OF THE PREFERRED EMBODIMENT

Figure 1:
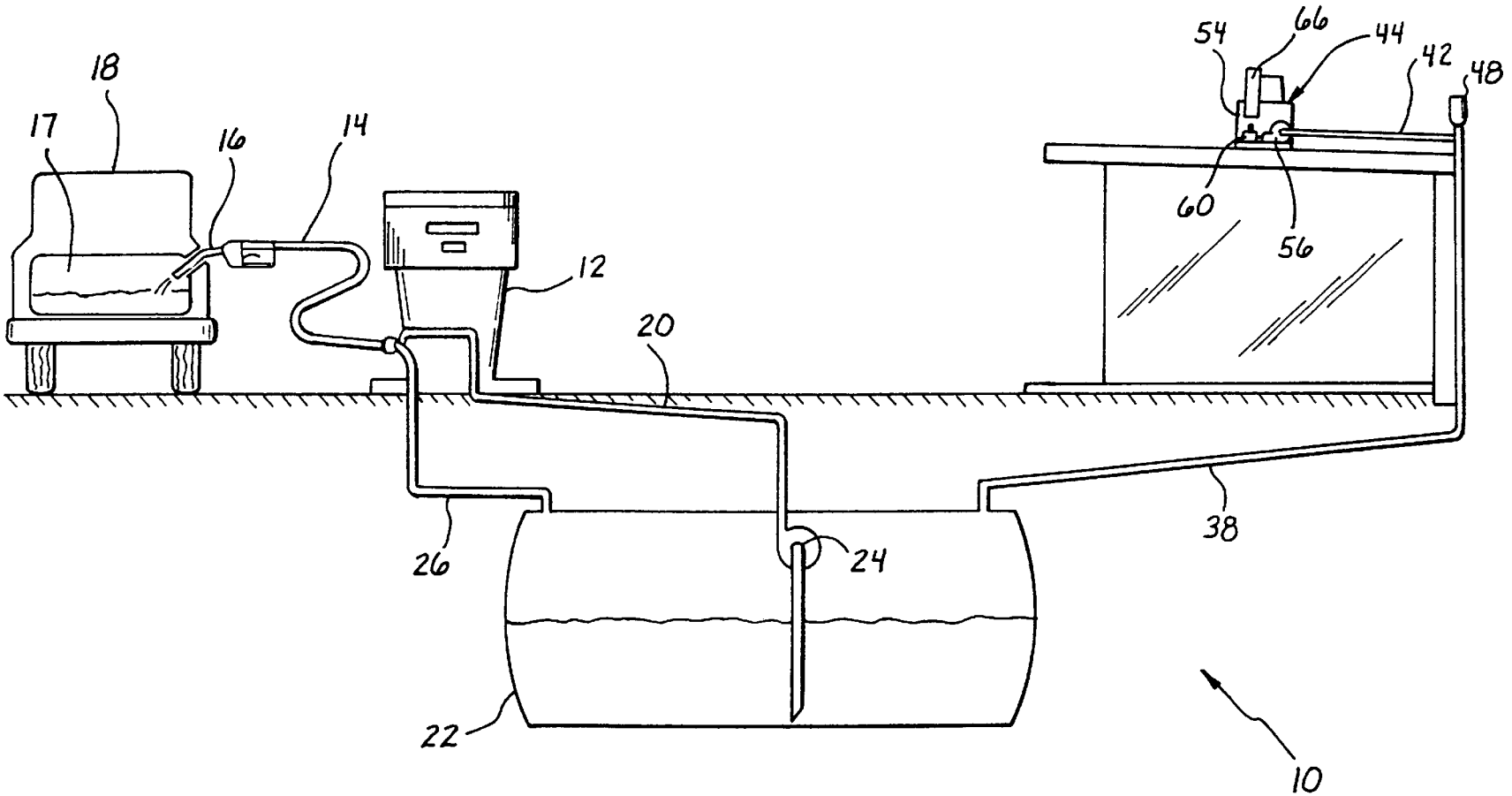
FIG. 1 is a schematic view of a system for controlling gasoline vapor emissions constructed in accordance with the principles of the present invention.
Figure 1A:
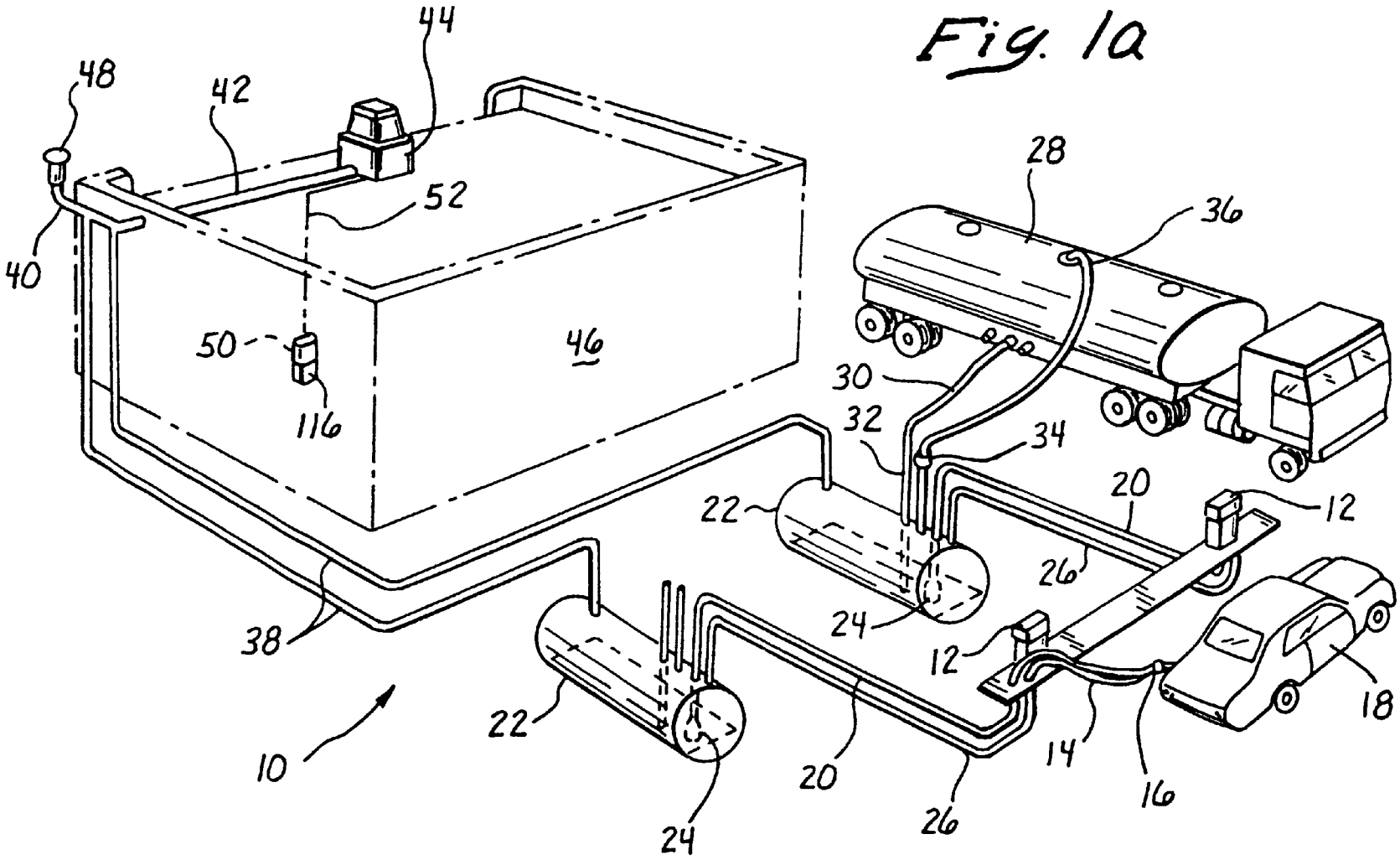
FIG. 1*a* is a perspective view of the system shown in FIG. 1.
Figure 2:
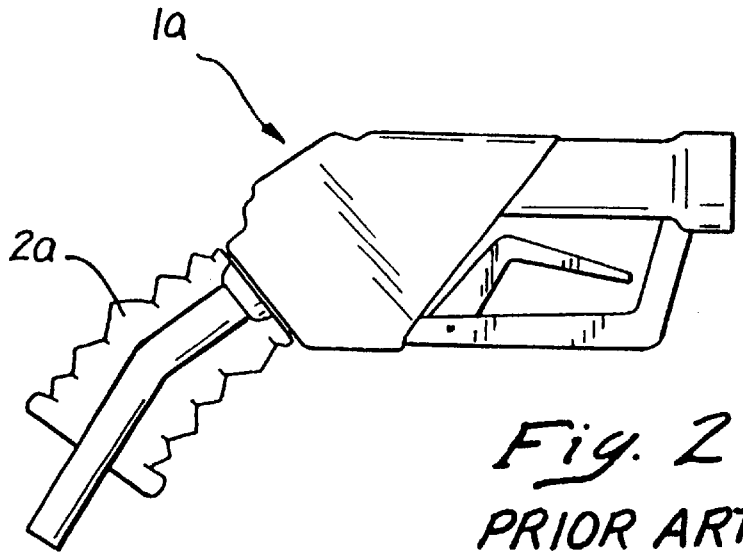
Fig. 2 PRIOR ART
FIG. 2 is a plan view of a booted balance system gasoline dispensing nozzle as is known in the prior art.
Figure 3:
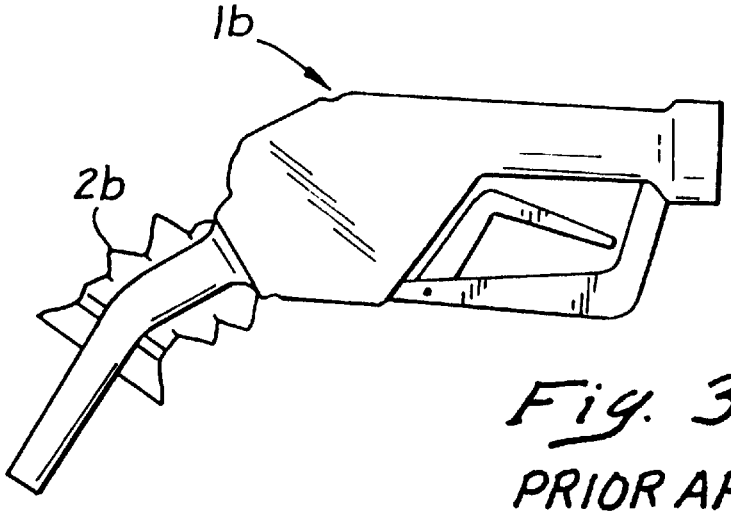
Fig. 3 PRIOR ART
FIG. 3 is a plan view of a booted partial-seal gasoline dispensing nozzle as is known in the prior art.

Referring first to FIGS. 1 and 1*a*, a service station is provided with facilities for storage and dispensing of fuel, such as liquid gasoline and for control and abatement of fuel vapors by burning. In FIGS. 1 and 1*a*, a system 10 for control and abatement of gasoline vapors includes a plurality of gasoline dispensers 12, each having a coaxial liquid gasoline dispensing hose 14 provided with a nozzle 16 for insertion into a fill pipe of a gasoline tank 17 (FIG. 1) of a vehicle 18. The coaxial hose 14 includes two hose lines connected to the nozzle 16, one hose line providing for passage of liquid gasoline through pipe 20 from a storage tank 22 to dispensers 12 and nozzles 16. A gasoline delivery pump 24 (FIG. 1) is provided for pumping the liquid gasoline from the tank 22 to the dispensers 12. The other hose line provides for passage of gasoline vapors from the vehicle tank 17 through pipe 26 to the storage tank 22.

FIG. 1*a* also schematically illustrates the filling of the underground tank 22 by a gasoline tank truck 28 having a fuel line 30 entering the underground tank 22 through an upstanding fill riser 32 which discharges liquid gasoline adjacent to the bottom of tank 22. Tank 22 also has an upstanding vent riser 34 which may be connected to a vapor return line 36 leading to the upper chamber portion of the tank so that vapor from the underground tank will be displaced and returned to the truck 28.

Since the system 10 is a substantially vapor-tight system, provision must be made for processing gasoline vapors accumulating in upper portions of underground storage tank 22. Accordingly, such vapors may flow through vent pipes 38 to a manifold 40 (FIG. 1*a*), and then through a tie 42 between the vent pipes 38 and a processor unit 44. Under conditions of nondispensing of gasoline from service dispensers 12 or nonfilling of the tanks by the tank truck 28, the vapor piping systems or that which contains gasoline vapors includes the space above the liquid level in each of the tanks 22, the vent pipes 38 leading from the tanks 22 to the manifold 40, tie 42, the vapor carrying pipes in the processor unit 44, the dispensing hose 14, and the vapor return line 26. Under conditions of filling the tanks 22 by tank truck 28, the vapor piping system includes the vapor return line 36. In the dispensing of gasoline to a vehicle 18 the vapor piping system includes the bootless nozzle 16.

The processor unit 44 may be installed on top of a service station 46 as illustrated in FIG. 1*a*, or elsewhere as fire safety rules permit. Adjacent manifold 40 may be a pressure/vacuum valve 48 in communication with the manifold 40. Preferably the horizontally disposed tie pipe 42 is pitched away from the processor unit 44 so that condensate which may appear in pipe 42 will be drained toward the manifold 40 and the tanks 22. A remote control panel 50 (FIGS. 1*a* and 8) may be located in the service station building, the remote control panel 50 being connected to the processor unit 44 by suitable cable 52.

The processor unit 44 and associated control systems and valving may be generally constructed in the manner disclosed in U.S. Pat. No. 4,680,004, herein expressly incorporated by reference, except for the inventive features as described hereinbelow. Within the processor unit housing 54 is a turbine 56 (FIGS. 1 and 5), which may comprise a small electric regenerative turbine as disclosed in the aforementioned Hirt '004 patent. Such an exemplary turbine utilizes a fractional (such as a 1/16 or 1/8) horsepower motor and is capable of moving 2¼ cubic feet per minute at 1 pound pressure per square inch. This is in contrast to prior art systems which often utilize ½ horsepower or greater motors, because a lot more vapor must be pumped. The turbine 56 has the capacity for quickly moving the vapor through the vapor piping system and is quickly responsive to changes from selected vacuum conditions in the vapor piping system. Downstream of turbine 56, vapor pipe 58 (FIG. 5) conducts the discharge vapor to a main and high flow burner 60 (FIGS. 1, 6 and 7), and by a pipe 62 (FIG. 5) connected to pipe 58 upstream of the main burner 60, vapor is conducted to a pilot burner 64.

Figure 7:
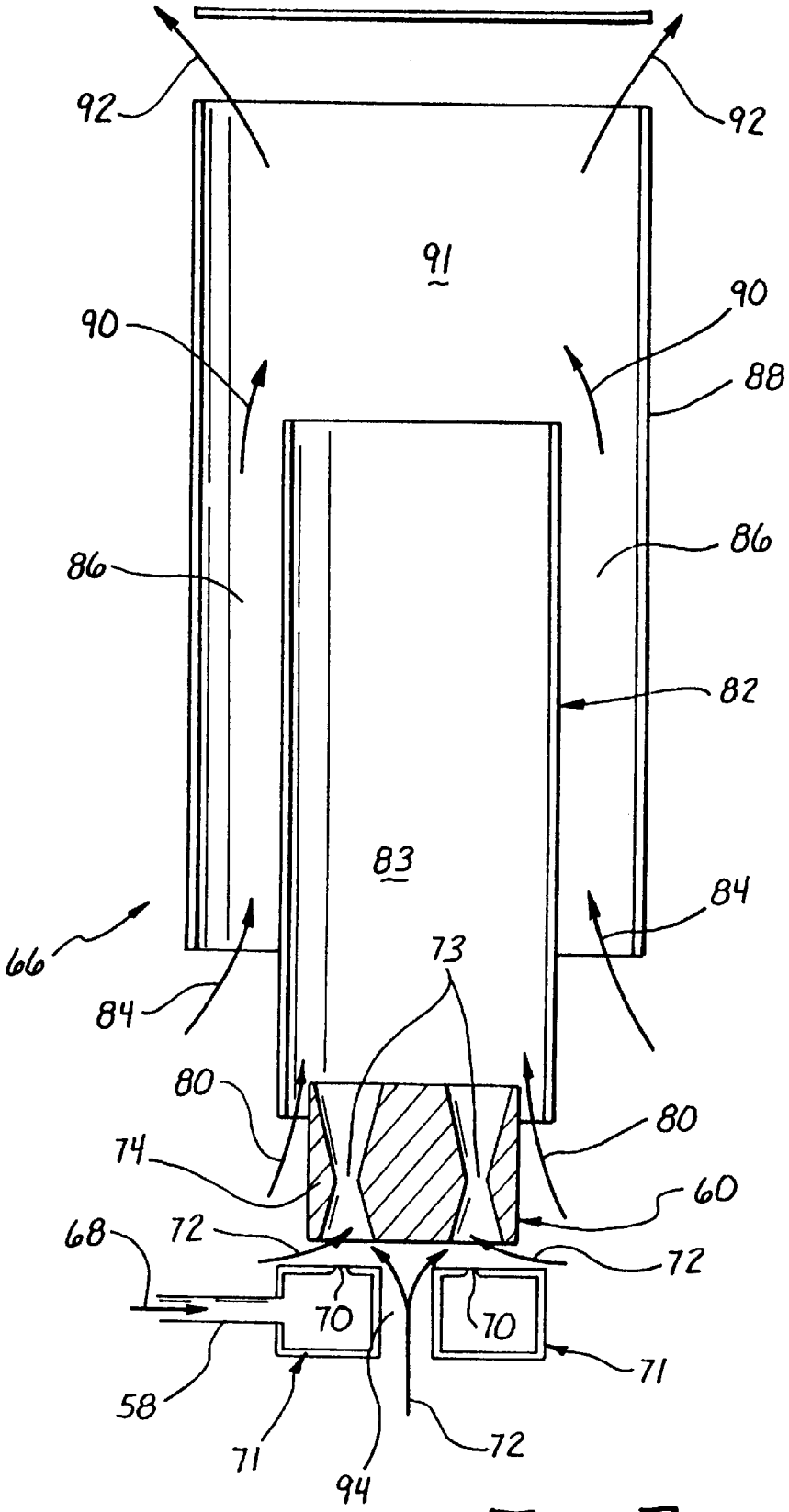
FIG. 7 is a schematic view illustrating a coaxial processor stack constructed in accordance with the principles of the invention for use in a system for controlling gasoline vapor emissions as shown in FIG. 1.

An important feature of the present invention is the implementation of a coaxial processor stack 66 (FIGS. 1 and 7). As is apparent from the foregoing description, in the design of a gasoline vapor control system, the primary component is the vapor processor 44. Inside the processor 44 is a thermal oxidizer (burner 60), the purpose of which is to destroy vapors which are so excess to the vapor storage capacity of the system that, if they are not destroyed, they would pressurize and escape to the atmosphere. Thus, we can immediately specify several functions for the burner and its exhaust stack:

1. The system must burn clean (i.e minimal oxides of nitrogen, hydrocarbons, ozone, and carbon monoxide);
2. The system must not make a visible flame or night-glow out of the top of its stack 66, in order not to alarm service station patrons;
3. The stack itself must not glow visibly;
4. The system must not give off sufficient heat to overheat the other components in the processor housing;
5. The system must resolve two problems which are unique to the inventive application; i.e. it must burn vapor which has a concentration varying from full lean to full rich, and it also must not permit the prevailing wind to blow its fire out (it is particularly susceptible to this, since it is typically exposed on the roof of a service station building);
6. Advantageously, the outer stack should be kept cool enough so that it may be made of mild steel instead of stainless steel; and
7. The vertical height of the stack must be kept to a minimum because of aesthetics and to ease compliance with local zoning ordinances.

As shown particularly in FIG. 7, coaxial stack 66 of the present invention is constructed such that gasoline vapor 68 enters the main pillbox burner 60 under pressure of the turbine vapor pump 56, having a minimum pressure of 15 inches water column (w.c.). Vapor is forced out through orifices 70 of the vapor manifold (pillbox) 71 at high velocity. High velocity serves two functions. First, it induces an increased flow of combustion air, as illustrated by arrows 72, which represent the flow of primary combustion air. Second it prevents the flame from burning back into the orifice and into the vapor pipe train because the velocity in the orifice throat is higher than the velocity of the propagation of flame through vapor.

Vapor and primary combustion air (oxygen bearing fresh air) mix and ignite in the throat 73 (first stage combustion zone) of ceramic tiles 74 which are venturi-shaped to promote mixing and ceramic to hold heat and flame. The holding of heat in the ceramic tiles of the burner 60 is vitally important to the burner's ability to remain burning while the concentration of the vapor changes.

Figure 4:
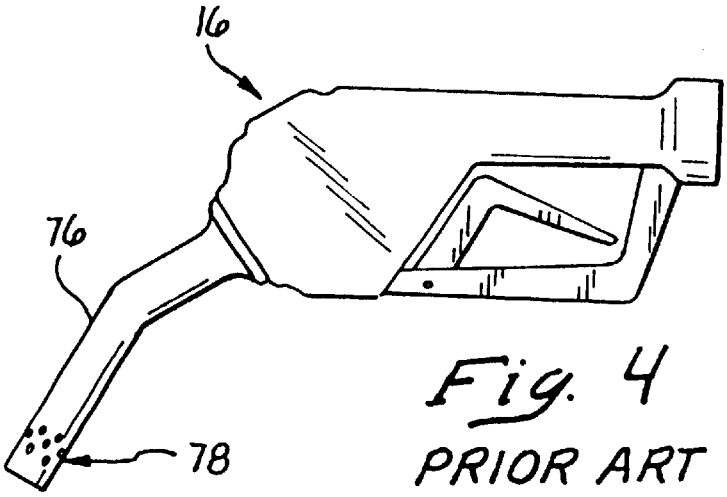
Fig. 4 PRIOR ART
FIG. 4 is a plan view of a bootless gasoline dispensing nozzle for use in the inventive gasoline vapor recovery system.

The issue of accommodation of vapor concentration changes arises because of the employment in the present inventive system of a bootless nozzle 16, as illustrated in FIG. 4. Bootless nozzles of this type are known in the prior art, and comprise a coaxial spout 76 having an inner tube (not shown) for carrying liquid gasoline to the vehicle tank and an outer tube (not shown) for returning gasoline vapor to the coaxial dispensing hose 14. Vapor ingestion ports 78 in the distal end of the spout 76 function to draw the gasoline vapor being displaced from the vehicle tank into the outer tube of the spout 76 for return to the underground tank 22. Because there is no boot to seal against the vehicle filler spout and ensure the return of substantially all gasoline vapors to the vapor recovery system, it is necessary to operate a bootless system under a substantial vacuum pressure (in an exemplary system, the optimal level of vacuum is 1/10 psi for a bootless nozzle system, versus 1/100 psi for a booted nozzle system). This vacuum pressure at the ports 78 functions to draw the gasoline vapors into the ports 78 rather than permitting them to escape to atmosphere.

As discussed supra, the concentration of the vapor changes because the bootless nozzle 16, having no seal, ingests some fresh air through the ports 78 as a result of the imposed vacuum pressure, and because the maintained vacuum level induces air ingestion through any existing leak. This variation in vapor concentration is a problem not encountered by designers of burners which burn natural gas, because the quality of natural gas is very constant.

Referring once again to FIG. 7, combustion flame is emitted from the tile venturi 74 and is mixed with secondary combustion air 80, which increases the probability that all hydrocarbons will be oxidized in the flame. Secondary combustion takes place inside an inner stack 82, in the second stage combustion zone 83. Additionally, fresh air flow 84 is induced through an annulus 86 between the inner stack 82 and an outer stack 88. This air 84 keeps the outer stack 88 cool, and the air 84 is preheated during its journey along the hot inner stack to become heated fresh air 90 at the top end of the inner stack 82. The heated fresh air 90 supplies warm oxygen to burn any residual hydrocarbon, in third stage combustion zone 91, not combusted during the first two combustion stages. Simultaneously, the air 90 quench-cools the burning stream 92 as it exits the outer stack 88, thereby reducing the probability that a glow or visible flame will be visible from the top of the outer stack.

The inventive coaxial stack burner design, affording three stage combustion and quench cooling of exhaust gases to eliminate flare-off, is superior to anything known or used in the industry, and solves problems related to the inventive gasoline vapor recovery system which were not known in connection with any other application.

Still referring to FIG. 7, the inventors have discovered an advantageous approach for constructing the pillbox burner 60. A pipe 94 is disposed through the manifold for entry of a portion of the primary combustion air 72 into the first stage combustion zone 73. The pipe 94 divides the pillbox manifold 71 into an annulus, as illustrated, which permits even distribution of the gasoline vapor to the spud holes 70, and a low pressure drop. Also, with this approach, the remaining primary combustion air 72 which does not traverse the pipe 94 can flow evenly around the periphery of the venturi mouths. The inventors have found that such a configuration permits the use of a smaller standard blower 56, and gives the turndown stability necessary for an open system.

The inventors have found that, with the open style system for Stage II vapor recovery, which uses the "bootless" dispensing nozzles discussed supra, a high turndown burner 60 is necessary. In situations where many people are dispensing gasoline into their vehicles during a bulk fill delivery from a tanker truck 28 (FIG. 1*a*), a high processing rate is needed. However, in instances where few or no people are dispensing fuel, a low processing rate is required to keep hydraulic shock from wearing out the vacuum switches utilized in the system.

Conventional design would call for using a larger blower 56 with a throttling flow control valve to obtain the desired turndown. However, this approach tends to complicate the system and the control logic required to keep it operational, and is therefore relatively expensive. Alternatively, the inventive system employs the standard turbine blower 56 employed by the closed system disclosed in the Hirt '004 patent, in conjunction with a multi-path pipetrain as illustrated in FIG. 5.

Figure 5:
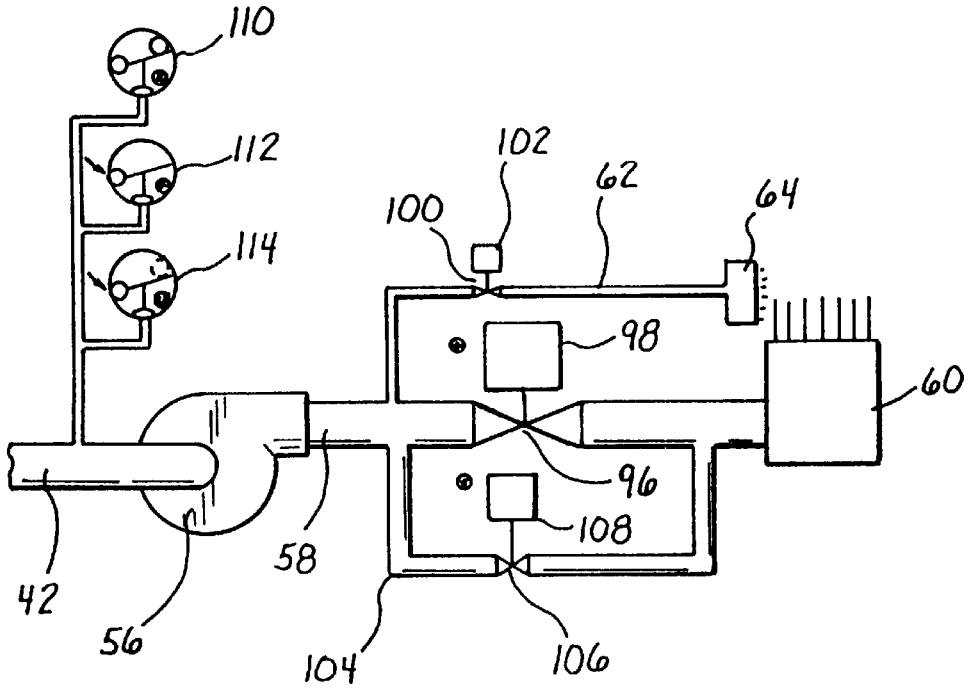
FIG. 5 is a schematic view illustrating the processor portion of the system shown in FIG. 1.

Referring now more particularly to FIG. 5, a high flow valve 96 is disposed in the main vapor pipe 58. A high flow solenoid 98 actuates the high flow valve 96 between its open and closed states. A pilot valve 100 is disposed in the pilot vapor pipe 62. A pilot solenoid 102 actuates the pilot valve 100 between its open and closed states. A main flow pipe 104 branches from the vapor pipe 58, bypassing the high flow valve 96. A main flow valve 106 is disposed in the main flow pipe 104, which is actuated between its open and closed states by means of a main flow solenoid 108.

In a preferred embodiment, gasoline vapor is supplied at pressure by the blower 56, with a maximum flow rate of 4.4 Standard Cubic Feet per Minute (SCFM). The main tie pipe 42 and main vapor pipe 58 upstream of the high flow valve 96 each have preferred diameters of 1 inch. Downstream of the valve 96, the diameter of the pipe 58 is preferably ⅜ inch. Pilot pipe 62 is preferably comprised of a ⅜ inch tube upstream of the pilot valve 100, and ¼ inch tubing downstream of the valve 100. Main flow pipe 104 is preferably comprised of ⅜ inch tubing along its entire length.

The multi-path pipetrain configuration herein described is efficiently operated using a set of vacuum switches to control the processing rate. In that regard, high flow vacuum switch 110, lesser vacuum switch 112, and greater vacuum switch 114 are provided (FIG. 5).

Figure 8:
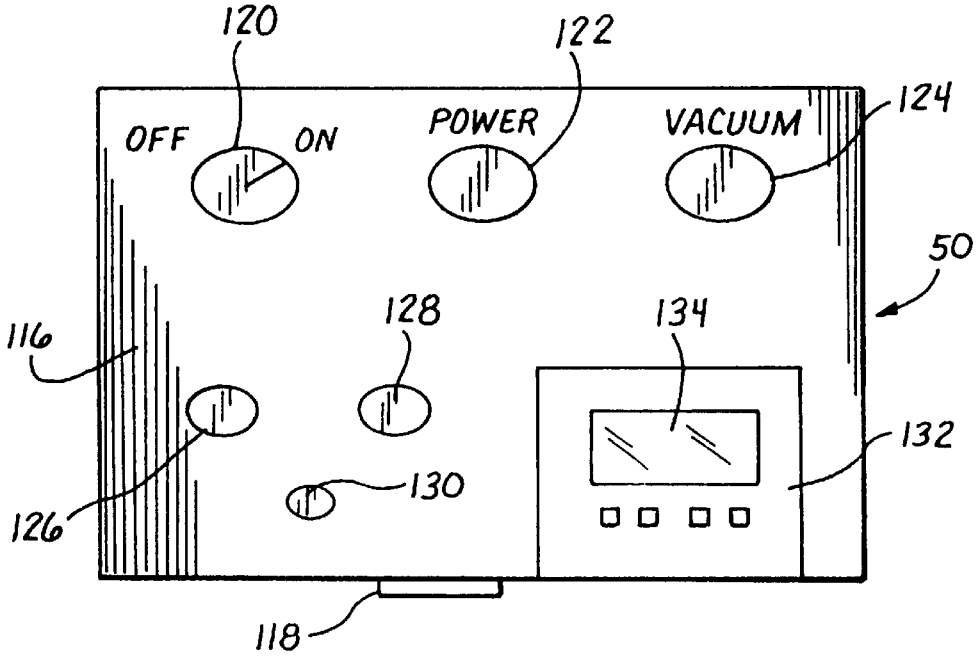
FIG. 8 is a schematic view illustrating a monitoring panel for use in the system as shown in FIG. 1.

One additional important feature of the inventive system 10 is the implementation of a remote self-test monitor 116 on the remote control panel 50 (FIGS. 1*a* and 8) in the interior of the service station 46. In prior art systems, there has not been any effective self-test capability, so it has been difficult to determine whether a system has been working correctly or not. Diagnosis of the system operation required the use of special test equipment, tools, and a knowledge of the behavior of the system, and no analysis could be conducted without physical access to the rooftop processor. However, with the increasing vigilance of governmental authorities, who have become more likely to regulate, inspect, cite, fine and shut down service stations whose pollution control equipment is not functioning properly, it has become more important to service station owners to have conveniently located monitoring equipment. Locating the remote self-test monitor in the building, convenient to the operator, and providing for an audible alarm in the event of improper system operation, creates three major advantages. First, the station owner/operator can hear the alarm, indicating improper operation of the system, and know immediately that corrective action is necessary. The system can even be configured for remote monitoring (i.e. an operator could monitor via phone or internet from a remote location). Second, a governmental inspector can learn all he needs to learn about system operation from the monitor screen, and does not have to access the roof. Finally, the processor housing can be sealed shut, thereby denying access to vandals, tinkerers, and others who do not have proper tools or authorization for repair. Two additional advantages of a sealed housing involve the alleviation of worry on the part of the station owner/operator that 1) a governmental inspector might measure something in the processor and announce that the system is not working properly and that a citation must be issued or the station shut down, or 2) that the inspector might not first come to the office to announce his arrival and intent to inspect. With the housing sealed and the monitoring equipment inside the station, the inspector must first announce his arrival to the owner/operator, and the owner/operator already knows (presumably) that the system is operating properly, or else alarms would have sounded. In many instances, because regulatory agencies typically permit a "fix-it" period of time before requiring shutdown, early diagnosis of a problem which is then promptly reported to authorities will innoculate an operator from citation during such a random inspection visit In a preferred embodiment, as illustrated in FIG. 8, the self-test monitor 116 comprises an audible alarm 118, a power switch 120, power and vacuum indicator lights 122 and 124, respectively, alarm silence and alarm indicator light 126 and 128, respectively, a fuse 130, and a paperless recorder 132 having a liquid crystal display 134. A significant advantage of the present system is that only one parameter need be monitored—total system pressure (vacuum pressure). As long as a vacuum persists during operation, even if there are leaks in the system, vapor collection efficiency will approach 100%.

In operation, referring in particular to the table shown in FIG. 6, the system 10 is advantageously designed to operate efficiently in three modes. In the idle mode, when no product dispensing occurs, the lesser vacuum switch 112 is in control and the system preferably maintains a vacuum setting of approximately −4.2 inches w.c.

When customers drive up to the dispensers 12 and begin dispensing gasoline into their vehicle tanks, demand on the system increases. As long as the vacuum level is below −4.35 inches w.c., the high flow vacuum switch 110 energizes to turn on the high flow valve 96. This will approximately double the flow rate to the burner 60 to approximately −4 SCFM, thereby giving the processor 44 a greater ability to generate vacuum. When the vacuum level reaches a predetermined setpoint (approximately −4.35 inches w.c. in the preferred embodiment), the high flow valve 96 is switched off and the main flow valve 106 remains actuated to take the vacuum level to −4.5 inches w.c. In the product dispensing mode, the vacuum level will be maintained at approximately −4.5 inches w.c. by the greater vacuum switch 114.

When, in addition to dispensing product into vehicle tanks, a gasoline delivery truck arrives to replenish the supply of gasoline into the underground tank 22 (a "bulk drop"), the system functions to compensate for this extreme demand in the same manner as described supra in connection with the higher demand generated by the dispensing of fuel into several vehicle tanks simultaneously. Again, the high flow switch 110 and valve 96 energize to give the processor a greater ability to generate vacuum and increase the vacuum level to −4.35 inches w.c., after which the high flow vacuum switch 110 will shut off, closing the high flow valve 96, and the greater vacuum switch 114 throttles the main flow valve 106 to maintain a vacuum level of −4.5 inches w.c. This state, with its higher vacuum setpoint of −4.5 inches w.c. will be maintained until demand on the system returns to an idle level, thereby causing the processor to return the system to the idle mode, and its lower vacuum setpoint of −4.2 inches w.c.

Important to the successful operation of the foregoing system is that the high flow vacuum switch 110 is a slave to either of the other two switches 112 and 114. Thus, regardless of the system mode, high flow volume may be activated on demand in order to ensure that desired vacuum level may be maintained continuously, so that the system is virtually never out of operational compliance with emissions regulations.

The monitor 116 functions by recording in real time, preferably in one minute increments, via the paperless recorder, the total system pressure. Preferably, this merely involves monitoring the status of the lesser vacuum switch. The status of the lesser vacuum switch is recorded periodically (in the preferred embodiment, once each minute) for an entire year. If the vacuum is sufficient to open the switch (i.e. in the preferred embodiment approximately −4.2 inches w.c. or greater), the recorder marks (0) VAC. If the vacuum decays below this setpoint level, thereby causing the lesser vacuum switch to close, the monitor notes the closed status of the switch. Should the switch 112 be detected in the closed status for a predetermined amount of time, such that it is presumable that the system has developed a leak which renders the processor incapable of generating sufficient vacuum pressure to overcome the loss of vacuum in the system due to the leak, the remote monitor 116 sounds the alarm horn 118, lights the alarm lamp 128, and the recorder marks the house voltage of approximately 120 VAC for the duration of the outage. The horn can be silenced by depressing button 126. However, if the malfunction has not been repaired, the horn will sound again after an hour has elapsed to remind the operator of the unresolved problem.

A plot of the recorded vacuum switch status checks may be displayed in LCD display 134, and may be printed out for any time increment up to one year earlier upon demand, using a supplied printer (not shown). Thus, the previous year's system history is available instantly if desired.

Leaks anywhere between the vapor valves and the storage tank will cause the processor to run excessively. Once the leak becomes large enough to overcome the processor, the vacuum condition will be lost and the monitor will sound the horn, light the alarm lamp, and record the outage. Leaks anywhere between the storage tank and the processor allow entrained air to dilute the vapor. By nature of its design, the processor cannot thermally oxidize an excessively diluted vapor stream. The processor thus shuts down to allow the vacuum to decay. Again, when the vacuum decays, the monitored vacuum switch is not actuated to its open position, and the alarm will be activated. Similarly, a bulk delivery conducted with poorly maintained equipment or performed with improper connection/disconnection procedures will also dilute the vapor stream sent to the processor. As a result, the processor will shut down and the monitor will go into alarm mode.

Thus, the processor 44 in the present inventive system functions to create a total system vacuum, by operation of the pump or turbine 56, monitor the vacuum pressure, by means of the monitor 116, and to process excess vapor, by means of he burner 60. The system is "foolproof", in that, as long as a negative system pressure is maintained, no leaks to atmospheric pressure will occur (all leaks will be into the lower region of pressure, i.e. inwardly into the underground tanks and related piping), and if the vacuum pressure falls below a predetermined parameter, indicating a system malfunction, such as leaky vapor valves, poorly maintained tank tops, processor malfunctions, improperly performed bulk deliveries, leaky Stage I hoses, leaky dispenser piping, leaky underground vapor return piping, and leaky P/V valve, an alarm is sounded.

Thus, the inventive system has at least the following advantages, among others: 1) an operator of a gasoline dispensing facility has a way to detect leaks in the vapor recovery system immediately upon occurrence; 2) an operator of a gasoline dispensing facility can determine when a bulk delivery driver uses worn out Stage I equipment or follows improper connect/disconnect procedures; and 3) the local inspector can inspect the record and determine whether operators and bulk delivery drivers are working diligently to keep the Stage I/II systems operational and leak-free throughout the year.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A fuel vapor emission control system, comprising:

a fuel storage tank;

a dispenser, hose, and nozzle for dispensing fuel into a vehicle, said nozzle being fluidly connected to said fuel storage tank;

a processor unit for processing excess fuel vapor accumulating in said fuel storage tank which comprises a pump for maintaining a vacuum pressure on the vapor in said system;

a first conduit disposed between said fuel storage tank, said dispenser hose, and said nozzle for returning fuel vapor from said nozzle to said fuel storage tank;

a second conduit for accommodating fuel vapor flow from said fuel storage tank to said processor unit, said pump being disposed on said second conduit, so that a vacuum side of said pump draws a vacuum in said storage tank; and a remote self-test monitor for detecting and recording, in real time, the pressure on the vapor in said system;

wherein said remote self-test monitor detects and records the pressure on the vapor in said system whether or not fuel is being dispensed.

2. The fuel vapor emission control system as recited in claim 1, and further comprising a vacuum switch which is operationally connected to said system, said vacuum switch being operable responsive to the vacuum pressure on said system between an open and a closed position, the vacuum switch being actuated to said open position when there is a desired vacuum pressure on said system, and being actuated to the closed position when the vacuum pressure on said system decays below a predetermined level, said remote self-test monitor detecting the pressure of said system by detecting the status of said vacuum switch, and functioning to actuate an alarm if the vacuum switch is actuated to its closed position.

3. The fuel vapor emission control system as recited in claim 2, wherein said remote self-test monitor actuates said alarm when said vacuum switch is actuated to its closed position for a predetermined period of time.

4. The fuel vapor emission control system as recited in claim 2, said vacuum switch comprising a lesser vacuum switch actuatable to maintain vacuum pressure in the system below a first predetermined level when the system is idle, and the system further comprising a greater vacuum switch actuatable to maintain vacuum pressure in the system below a second predetermined level when the system is in a product dispensing mode, the second predetermined vacuum pressure level being lower than the first predetermined vacuum pressure level.

5. The fuel vapor emission control system as recited in claim 4, wherein said first predetermined vacuum pressure level is approximately −4.2 inches w.c. and the second predetermined vacuum pressure level is approximately −4.5 inches w.c.

6. The fuel vapor emission control system as recited in claim 1, wherein said remote self-test monitor is disposed in the interior of a service station.

7. The fuel vapor emission control system as recited in claim 1, wherein said remote self-test monitor comprises a paperless recorder for recording the system pressure in real time.

8. The fuel vapor emission control system as recited in claim 7, wherein said remote self-test monitor records the system pressure in one minute increments.

9. The fuel vapor emission control system as recited in claim 1, wherein said remote self-test monitor comprises an alarm lamp, audible alarm, and a display screen.

10. The fuel vapor emission control system as recited in claim 1, wherein said processor unit further comprises a burner for thermally oxidizing said excess fuel vapor.

11. A fuel vapor emission control system, comprising:

a fuel storage tank;

a dispenser comprising a hose and a bootless nozzle for dispensing fuel into a vehicle;

a first conduit disposed between said fuel storage tank and said bootless nozzle for supplying fuel from said storage tank to said dispenser;

a second conduit disposed between said bootless nozzle and said fuel storage tank for returning fuel vapor from said bootless nozzle to said fuel storage tank;

a processor unit for processing excess fuel vapor accumulating in said fuel storage tank which comprises a system for abating excess fuel vapor and a pump for maintaining a vacuum pressure on the vapor in said fuel vapor emission control system; and a third conduit for accommodating fuel vapor flow between said fuel storage tank and said processor unit;

wherein said pump is disposed on said third conduit, downstream of said fuel storage tank, so that a vacuum side of said pump draws a vacuum in said fuel storage tank.

12. The fuel vapor emission control system as recited in claim 11, and further comprising a remote self-test monitor for detecting and recording, in real time, the vacuum pressure of said fuel vapor emission control system.

13. The fuel vapor-emission control system as recited in claim 11, wherein said thermal oxidation system comprises a burner.

14. A fuel vapor emission control system, comprising:

a fuel storage tank;

a nozzle for dispensing fuel into a vehicle, said nozzle being fluidly connected to said fuel storage tank;

a first conduit for returning fuel vapor from said nozzle to said fuel storage tank;

a second conduit for removing excess fuel vapor from said fuel storage tank;

a processor unit for processing said excess fuel vapor accumulating in said fuel storage tank which comprises a system for abating excess fuel vapor and a pump for maintaining a vacuum pressure on said fuel vapor emission control system; and a multipath pipetrain for directing said excess fuel vapor to said fuel vapor abatement system, said multipath pipetrain comprising a high flow vapor pipe having a high flow valve therein and a second flow pipe disposed to branch off from said high flow vapor pipe, the second flow pipe having a second valve disposed therein;

wherein said pump is disposed upstream of the junction between said high flow vapor pipe and said second vapor pipe.

15. The fuel vapor emission control system as recited in claim 14, wherein said second flow pipe comprises a main flow pipe, and the second valve comprises a main flow valve.

16. The fuel vapor emission control system as recited in claim 14, and further comprising a pilot flow pipe disposed to branch off from said high flow vapor pipe, the pilot flow pipe having a pilot flow valve disposed therein.

17. The fuel vapor emission control system as recited in claim 14, and further comprising a vacuum switch for controlling the processing rate of said processor unit.

18. The fuel vapor emission control system as recited in claim 17, wherein said vacuum switch comprises a high flow vacuum switch.

19. The fuel vapor emission control system as recited in claim 18, and further comprising a lesser vacuum switch and greater vacuum switch.

20. The fuel vapor emission control system as recited in claim 19, wherein said lesser vacuum switch controls the system in an idle operating mode when no product dispensing is taking place, to maintain the system vacuum pressure at a first predetermined level.

21. The fuel vapor emission control system as recited in claim 20, wherein said first predetermined level is approximately −4.2 inches w.c.

22. The fuel vapor emission control system as recited in claim 20, wherein said high flow vacuum switch is a slave to both of said greater and said lesser vacuum switches.

23. The fuel vapor emission control system as recited in claim 20, wherein said high flow vacuum switch actuates said high flow valve when there is a need for a high rate of vacuum generation.

24. The fuel vapor emission control system as recited in claim 23, wherein at a second predetermined vacuum pressure level said high flow valve is turned off while the main flow valve remains on to take the vacuum pressure level to a third predetermined level.

25. The fuel vapor emission control system as recited in claim 24, wherein said second predetermined vacuum pressure level is −4.35 inches w.c. and said third predetermined vacuum pressure level is −4.5 inches w.c.

26. The fuel vapor emission control system as recited in claim 24, wherein in a product dispensing mode, the third predetermined vacuum pressure level is maintained by the greater vacuum switch.

27. The fuel vapor emission control system as recited in claim 19, wherein said system includes an idle mode, and a product dispensing mode, said system providing a high vapor flow volume on demand in order to ensure that a predetermined desired vacuum pressure level may be maintained continuously.

28. The fuel vapor emission control system as recited in claim 27, wherein said high flow vacuum switch acts as a slave to both of said greater and said lesser vacuum switches in order to provide said high vapor flow volume on demand.

29. A processor subsystem for use in a fuel vapor emission control system which comprises a fuel storage tank, a nozzle for dispensing fuel into a vehicle, and a conduit disposed downstream of said fuel storage tank for removing excess fuel vapor from the fuel storage tank, the processor subsystem comprising:

a processor unit for processing and abating excess fuel vapor accumulating in said fuel storage tank, said processor unit including a pump for maintaining a vacuum pressure on the vapor in said system, said pump being disposed in said conduit downstream of said fuel storage tank, such that a vacuum side of said pump draws a vacuum in said tank; and a remote self-test monitor for detecting and recording, in real time, the pressure of said system, wherein said remote self-test monitor detects and records the pressure on the vapor in said system whether or not combustible fuel is being dispensed.

30. The processor subsystem as recited in claim 29, and further comprising a vacuum switch which is operationally connected to said system, said vacuum switch being operable responsive to the vacuum pressure on said system between an open and a closed position, the vacuum switch being actuated to said open position when there is a desired vacuum pressure on said system, and being actuated to the closed position when the vacuum pressure on said system decays below a predetermined level, said remote self-test monitor detecting the pressure of said system by detecting the status of said vacuum switch, and functioning to actuate an alarm if the vacuum switch is actuated to its closed position.

31. A processor subsystem for use in a fuel vapor emission control system which comprises a fuel storage tank, a nozzle for dispensing fuel into a vehicle, and a conduit disposed downstream of said fuel storage tank for removing excess fuel vapor from the fuel storage tank, the processor subsystem comprising:

a processor unit for processing excess fuel vapor accumulating in said fuel storage tank, comprising a system for abating excess fuel vapor and a pump for maintaining a vacuum pressure on vapor in said fuel vapor emission control system; and a multipath pipetrain for directing said excess fuel vapor to said fuel vapor abatement system, said multipath pipetrain comprising a high flow vapor pipe having a high flow valve therein and a second flow pipe disposed to branch off from said high flow vapor pipe, the second flow pipe having a second valve disposed therein;

wherein said pump is disposed upstream of the junction between said high flow vapor pipe and said second flow pipe.

32. A combustible fuel vapor emission control system, comprising:

a fuel storage tank;

a dispenser, hose, and nozzle for dispensing fuel into a vehicle, said nozzle being fluidly connected to said fuel storage tank;

a processor unit for processing excess combustible fuel vapor accumulating in said combustible fuel storage tank, which comprises a pump for maintaining a vacuum pressure on the vapor in said system, said pump being disposed between said fuel storage tank and said burner, so that a vacuum side of said pump draws a vacuum in said tank;

a first conduit disposed between said fuel tank, said dispenser hose, and said nozzle for removing fuel vapor from said nozzle;

a second conduit disposed between said fuel tank and said processor unit for removing excess fuel vapor from said fuel tank; and a remote self-test monitor for detecting and recording, in real time, the pressure on the vapor in said system, said monitor operating continuously to detect and record the pressure on the vapor in said system, whenever the system is activated so that fuel can be dispensed therefrom.

33. A fuel vapor emission control system, comprising:

a fuel storage tank;

a dispenser for dispensing fuel into a vehicle, said dispenser being fluidly connected to said fuel storage tank;

a processor unit for processing excess fuel vapor accumulating in said fuel storage tank which comprises-a pump for maintaining a vacuum pressure on said system;

a conduit disposed between said combustible fuel tank and said processor unit for removing excess fuel vapor from said fuel tank; and a remote self-test monitor for detecting and recording, in real time, the pressure on the vapor in said system;

wherein said pump maintains a first lesser level of vacuum when the system is in an idle mode and not dispensing fuel, and maintains a second greater level of vacuum when the system is in a dispensing mode and is dispensing fuel.

34. The fuel vapor emission control system as recited in claim 33, and further comprising a vacuum switch for controlling the processing rate of said processor unit.

35. The fuel vapor emission control system as recited in claim 34, wherein said vacuum switch comprises a high flow vacuum switch.

36. The fuel vapor emission control system as recited in claim 35, and further comprising a lesser vacuum switch and a greater vacuum switch.

37. The fuel vapor emission control system as recited in claim 36, wherein said lesser vacuum switch controls the system in an idle operating mode when no product dispensing is taking place, to maintain the system vacuum pressure at a first predetermined level.

38. The fuel vapor emission control system as recited in claim 37, wherein said high flow vacuum switch is a slave to both of said greater and said lesser vacuum switches.

* * * * *

UNITED STATES PATENT AND TRADEMARK OFFICE

CERTIFICATE OF CORRECTION

PATENT NO. : 6,478,576 B1
DATED : November 12, 2002
INVENTOR(S) : Bradt et al

It is certified that error appears in the above-identified patent and that said Letters Patent is hereby corrected as shown below:

Title page,
Item [57], ABSTRACT, after “a” change “flirt” to -- Hirt --; after “to” change “flirt” to -- Hirt --.

Column 4,
Line 38, after “remote” change “self-zest” to -- self-test --.

Column 12,
Line 29, after “of” change “he” to -- the --.

Signed and Sealed this

Twenty-eighth Day of September, 2004

JON W. DUDAS
*Director of the United States Patent and Trademark Office*